US008250796B2

(12) United States Patent
Padgett et al.

(10) Patent No.: US 8,250,796 B2
(45) **Date of Patent: *Aug. 28, 2012**

(54) WEARABLE BANDS WITH INTERCHANGEABLE RFID MODULES ALLOWING USER SIZING AND PERSONALIZATION

(75) Inventors: John M. Padgett, Clermont, FL (US); Michael G. Jungen, Orlando, FL (US); John David Worrall, Clermont, FL (US); Maximillian Philip Burton, San Francisco, CA (US); Carson Lau, San Francisco, CA (US); Adam D. Leonards, El Cerrito, CA (US)

(73) Assignee: Disney Enterprises, LLC, Burbank, CA (US)

( * ) Notice: Subject to any disclaimer, the term of this patent is extended or adjusted under 35 U.S.C. 154(b) by 284 days.

This patent is subject to a terminal disclaimer.

(21) Appl. No.: 12/714,711

(22) Filed: Mar. 1, 2010

(65) Prior Publication Data

US 2011/0209372 A1 Sep. 1, 2011

(51) Int. Cl.
*A44C 5/00* (2006.01)

(52) U.S. Cl. ..... 40/633; 283/75; 63/3.2

(58) Field of Classification Search ..... 40/633, 40/665; 283/75; 63/6, 5.1, 3.1, 3.2, 21; 24/3.2
See application file for complete search history.

(56) References Cited

U.S. PATENT DOCUMENTS

| | | | | |
|---|---|---|---|---|
| 2,219,277 | A * | 10/1940 | Kaufmann | 63/21 |
| 4,742,503 | A | 5/1988 | Braun et al. | |
| 4,906,025 | A | 3/1990 | Schreindl | |
| 4,956,931 | A * | 9/1990 | Selke | 40/633 |
| 5,065,376 | A | 11/1991 | Choulat | |
| 5,416,953 | A | 5/1995 | Hui | |
| 5,746,501 | A * | 5/1998 | Chien | 362/103 |
| 7,041,032 | B1 | 5/2006 | Calvano | |
| 7,348,888 | B2 | 3/2008 | Girvin | |
| 7,481,370 | B2 | 1/2009 | Davis | |
| 7,845,191 | B2 * | 12/2010 | Czajka et al. | 63/15.6 |
| 2005/0046175 | A1 * | 3/2005 | Fox | 283/75 |
| 2005/0108912 | A1 * | 5/2005 | Bekker | 40/633 |
| 2009/0096614 | A1 | 4/2009 | Singleton et al. | |
| 2009/0265971 | A1 * | 10/2009 | Cook | 40/633 |
| 2011/0197483 | A1 * | 8/2011 | Gray et al. | 40/633 |
| 2011/0209313 | A1 * | 9/2011 | Padgett et al. | 24/68 BT |
| 2011/0209373 | A1 * | 9/2011 | Padgett et al. | 40/633 |
| 2011/0209375 | A1 * | 9/2011 | Padgett et al. | 40/633 |

OTHER PUBLICATIONS

Wristloks, http://www.adsources.com/CATALOG/wristlocks.htm, retrieved on Dec. 14, 2009, Wristlocks Wristbands.

Synometrix, http://www.synometrix.com/china_taiwan_rfid_bracelets.shtml, RFID Wristbands & RFID Bracelets & FRID Bracelet Manufacturers China Asia, retrieved on Dec. 14, 2009.

* cited by examiner

*Primary Examiner* — Lesley D Morris
*Assistant Examiner* — Kristina Junge
(74) *Attorney, Agent, or Firm* — Marsh Fischmann & Breyfogle, LLP; Kent A. Lembke

(57) ABSTRACT

A wearable band with an adjustable size or length and with an interchangeable identification (ID) element. The band includes a first band element with a recessed surface for receiving and retaining the identification element such as with its included ID module extending through a hole in the first band element body. To allow user sizing, the wearable band includes a second band element with a planar body extending from a first to a second end. The second band element body is greater in length than the first band element body and includes a hole for receiving the first band element body. The band includes a coupling mechanism that detachably connects an outer sidewall of the first band element body to the inner sidewall of the second band element body, e.g., to allow the two band elements to be selectively disconnected and reassembled without tools.

14 Claims, 8 Drawing Sheets

WEARABLE BANDS WITH INTERCHANGEABLE RFID MODULES ALLOWING USER SIZING AND PERSONALIZATION

BACKGROUND

1. Field of the Description

The present description relates, in general, to wearable bands, such as wristbands, chokers, and anklets, that are adjustable in size, and, more particularly, to wearable band assemblies that include an interchangeable identification member or element and a multi-sizing mechanism that allows the band to be sized in a tool-less manner by a user or wearer through the use of interlocking layers or differing band elements that can be combined to define the size (or length) of a band.

2. Relevant Background

Bands including wristbands are worn in numerous settings. For example, watches have typically been worn on a wrist through the use of a wristband. In hospitals, patients often are provided an identification bracelet, strap, or band that they wear on their wrist. An amusement or theme park may provide a visitor or guest with a wristband that includes identification information or technology (e.g., a readable bar code, a radio frequency identification (RFID) transceiver, or the like) that identifies the visitor and allows the visitor to access the park's facilities. Often, bands are worn as fashion accessories or to allow the wearer to make a statement (e.g., to support a cause such as medical research, a political candidate, a sports team, or the like). It is likely that the demand for wearable bands such as wristbands will continue to grow in the coming years.

One ongoing challenge for the makers of wristbands and other wearable bands is providing proper sizing for the end users. For example, most multi-size wristwatches include a first band portion that is attached at a first end to the timepiece and at a second end may have a number of spaced apart holes. A second band portion is attached at its first end to the timepiece and at its second end may contain a buckle-style clasp mechanism for mating with the holes of the first band portion. A person uses the clasp mechanism to both size the band about their wrist and to also lock the timepiece to their wrist.

The wristwatches are multi-size in that the spaced apart holes allow the same wristwatch to be worn by a set of people whose wrists have a size that falls within a predefined range (e.g., a minimum and maximum sized wrist diameter defined by the first and last hole on the band). However, people outside this predefined range would not be able to wear the wristwatch, and the wristwatch manufacturer either simply loses these sales or may provide additional wristwatches that have different size ranges to suit these other buyers. Unfortunately, this requires added inventory that may or may not be sold. Some efforts have been made to provide band designs that allow the band to be sized for a particular person, but these designs typically require specialized tools to adjust the band and are expensive to manufacture. In other cases, a band selected for a user to match their wrist size may be attached to the timepiece, but, again, this typically requires a special tool for attachment of the band to the timepiece and may require the buyer to have the watch sized by a trained technician.

As another example of the use of wearable bands, RFID wristbands are commonly used in hospitals and entertainment venues to identify individual patients and guests. The wristband may include or provide a link to a variety of information such as the person's name, their room number, a seating location for a show, entitlements permitted in the hospital or venue, and so on. The wristband is often designed to be secured or locked onto the wrist of the person during their stay at the hospital or participation in an entertainment event.

While these wristbands have been useful in identifying the patients and guests, their design has typically not effectively accommodated the wide range of users' wrists, which has resulted in many users having very loose bands or having too tight and uncomfortable fitting wristbands. Additionally, many wristband designs use either an adhesive closure that is peeled away from the wristband or a separate, one-time plastic snap closure. The adhesive closures sometimes do not provide the closing strength desired and, once removed, cannot be worn again. The plastic snap closures provide greater closing strength but often are intentionally designed for one time use, which limits use of these bands on an ongoing or repeated basis. Further, the snap closures often do not support a large enough range of wrist sizes such that they are often too tight or cannot be worn comfortably or are too loose which may allow them to fall off.

Accordingly, there remains a need for a low cost, multi-sizing mechanism for RFID wristbands and other wearable bands or straps. The band designs preferably would have durable opening and closing features to allow reuse of the band and would support relatively inexpensive manufacture from a variety of available materials such as plastics, silicones, metals, leathers, cloths, and/or other materials used presently (and in the future) for wearable bands. Further, there is a need for such a multi-sizing mechanism to be more fully adjustable to the wearer's wrist size, to provide a secure fastening mechanism that during regular wear can be fastened and unfastened by the wearer with ease, and to provide an aesthetic appearance that accommodates different wrist sizes within a large audience or wearer demographic.

SUMMARY

To address the above and other problems with wearable bands such as identification bands, a wearable band design is provided that allows a wearer to easily create a wearable identification band by combining an identification (ID) member or element (such as a body with an embedded RFID tag) with a receiving band assembly. The receiving band assembly may be configured to readily allow the user to adjust the size of the band to suit the size of their wrist (or other body part such as the ankle or neck). Generally, a wearable band assembly is provided that includes a centrally-located ID member coupled with (or received in) a receiving band assembly.

The receiving band assembly, in one embodiment, includes a first or inner layer/band element which may take the form of a thin or planar body (which may generally be rectangular with rounded ends). This inner band element may include a recessed surface for receiving the ID member along with a mechanism for coupling or interlocking with the ID member (e.g., holes fully or partially through the body for receiving posts/prongs provided on each end of the ID member (or its body)). The inner band element (or product platform/band) may then be coupled to the wearer or user such as with a clasp or buckle provided on the ends of the inner band element body. Sizing and personalization are provided in such embodiments by the selection of the inner band element body to provide a desired length for proper sizing to the user or graphical design, shape, color, material, or other features providing personalization.

In some cases, the receiving band assembly is also configured for sizing by the user to their wrist (or other body part receiving the wearable band assembly such as the neck or an ankle) In such cases, the receiving band assembly may further include a second band element with a planar body having a length that exceeds the first band element body's length and includes a central hole defined by an inner sidewall. When the inner band element is received in this hole its outer sidewall is coupled to the inner sidewall of the second band element (e.g., these two mating/abutting sidewalls provide a coupling or interconnecting mechanism with their configuration such as to provide a tongue and groove arrangement or a zipper/snap type arrangement). Typically, the coupling mechanism is designed for detachable coupling/connection so as to allow the second band element to be removed and then later reattached (or replaced by a different band element that allows personalization/customization of the band assembly).

The receiving band assembly may further include a third band element with a planar body having a hole for receiving the second band element body so as to further lengthen the wearable band assembly, and these two band elements or layers are likewise joined at their mating sidewalls. A series of holes may be provided along the end portions of each of the band elements along with a clasp device to allow the wearable band assembly to be attached to a wearer and to provide an amount of size adjustment. Larger size adjustments are made by removing a layer or outer band element such as by removing the third layer or band element from the second layer or band element or by removing the second layer or band element from the first or inner band element.

More particularly, a wearable band assembly is provided (such as a wristband or the like) that may be configured with an adjustable size or length and with identification technology (such as with an RFID module storing wearer identification and other data). The assembly includes an interchangeable band member that includes a planar body with a raised or protruding center portion that may include an embedded ID module (such as an RFID component). The band assembly includes a first band element (or layer) with a body extending from a first to a second end and with an outer shape defined by an outer sidewall. The body of this first band element may include a recessed surface for receiving the interchangeable band member body. The body of the first band element may also include a passageway or hole such that the center portion of the interchangeable band member body may extend through (e.g., so a decorative or functional component may be visible in the band assembly such as a timepiece or a decorative cover to an RFID module or the like). The interchangeable band member body is typically coupled to the first band element body when it is positioned in the recessed surface such as with a snap-in connection between the passageway sidewall and the raised center portion sides and/or via holes/posts provided on the two abutting bodies of the interchangeable band member and the first band element.

To allow a wearer to selectively size the band assembly, the band assembly further includes a second band element with a body extending from a first to a second end. The second band element body has a length that is greater than the length of the first band element body and includes a hole for receiving the first band element body (e.g., the second band element body extends about or surrounds in a concentric ring the first band element body). The band assembly also includes a coupling mechanism that detachably connects the outer sidewall of the first band element body to the inner sidewall of the second band element body (e.g., to allow the two band elements to be selectively disconnected and reassembled without tools).

The bodies of the two band elements may be generally planar (e.g., elongated rectangles with rounded ends or other shapes), and the coupling mechanism may include a first coupling component extending along the outer sidewall of the first band element and a second coupling element extending along the inner sidewall of the second band element such that the two band elements are connected along the entire periphery of the hole (or their abutting sidewalls). For example, the coupling mechanism may take the form of a tongue and groove arrangement with the tongue provided on either sidewall and the groove or recessed surface for receiving this tongue provided on the other sidewall. In such cases, the body near the tongue/post may be greater in hardness than that of the groove so as to enhance the coupling of the two bodies together (and this locking may be furthered by providing friction ridges on the post and/or groove sidewalls).

In another example, the coupling mechanism may include a vertical wall element spaced apart from the outer sidewall of the first band element body (e.g., an L-shaped extension to provide a coupling component) so as to define a groove. The coupling mechanism may also include a vertical post element spaced apart but attached to the inner sidewall of the second band element body, with the groove having a cross sectional shape for receiving a tip or head on the end of the vertical post element (e.g., the coupling mechanism may provide a zipper-like coupling). In other embodiments of the wearable band assembly, a third band element is provided with an elongate body having a hole for receiving the second band element body and to detachably couple with the outer sidewall of this received second band element body (e.g., further lengthen the band by adding an additional outer concentric ring). The first or inner band element may include a user identification member such as an RFID tag.

DETAILED DESCRIPTION OF THE PREFERRED EMBODIMENTS

Figure 1:
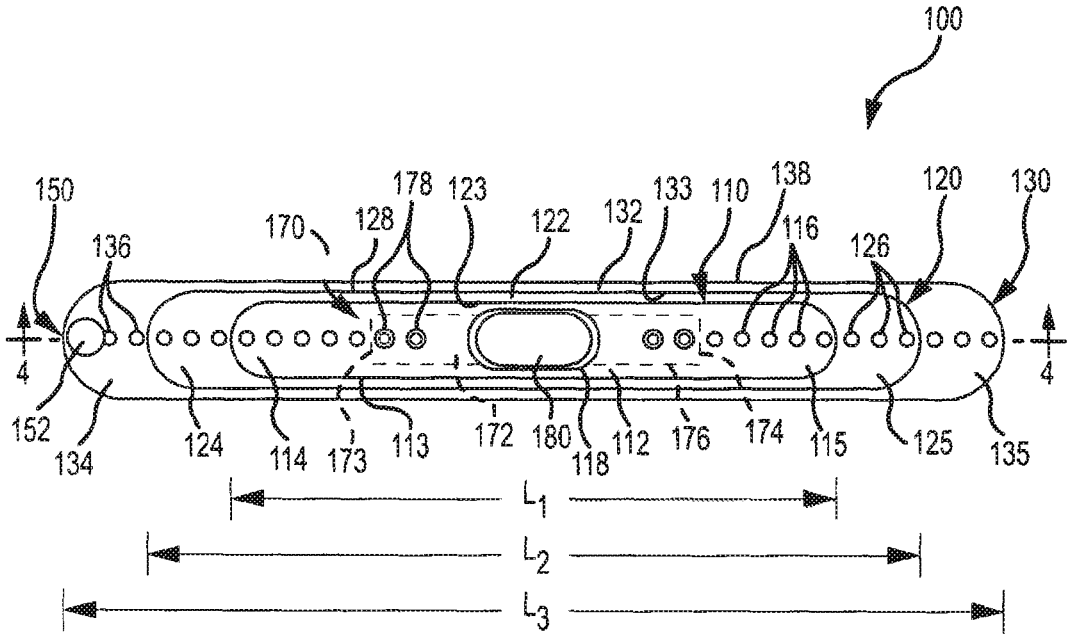
FIG. 1 is a top view of a wearable band assembly of an embodiment of this description as may be delivered to a purchaser or wearer including a removable or interchangeable ID member or element (e.g., assembled to have a maximum or largest length such as to suit a maximum sized wrist or to suit a group or range of larger wrist sizes)

The following description is generally directed toward a wearable band such as a wristband that may be readily configured to one of two or more sizes by adding or removing band layers or band sizing elements (or simply "band elements") and that may include a selectively removable ID member or element (such as a body with an embedded RFD module or the like). The attached figures illustrate several embodiments of such a wearable band, but, prior to describing these band embodiments, it may be useful to more generally describe exemplary wearable bands (which may also be called wristbands herein without being limited to use on a wrist as they may be worn on other parts of the body) and advantages of such bands when compared with existing bands or straps. Additionally, the following description highlights use of the bands as an RFID wristband, but it will be understood based on the description that the bands can be used with nearly any identification technology (such as barcodes or the like) as well as for bands without identification technologies/readable information. For example, the bands may be used with timepieces/watches or as products worn for fashion or other reasons.

Generally, the wearable bands described herein are designed to address or solve the multi-sizing and fastening mechanism problem that faces makers of wrist and other bands. The bands are easy for end users to assemble or configure so as to include an interchangeable ID member or element and to configure into a particular size. Personalization or modification is also allowed via interchanging of band layers/elements to personalize the bands by inclusion of differing band configurations (such as differing graphical designs, differing materials, differing colors, and so on in a "product platform" provided by the sizing or receiving band assembly). The bands of some embodiments are also adapted to make manufacture relatively inexpensive as one base design provides a multi-size band that can be used by all or a large portion of the population with the insertion of the ID member or element, and the supply chain is also simplified in this manner as one or several base designs may be offered to the consumers (e.g., a base ID member and/or a base receiving band assembly that can then be modified to size to the wearer), who can optionally personalize their bands by purchasing personalized/customized portions of the receiving band assembly.

In one example, an adjustable RFID wristband is provided that can be manufactured from a variety of modern day materials including plastics, rubbers, and silicones and even, in some cases, metals, leathers, cloths/textiles, and other materials. The wristband is fully adjustable by the wearer to suit their wrist size and also provides an aesthetic appearance. The wristband is also adapted to provide a secure wristband fastening mechanism that during regular wear can be fastened and unfastened by the wearer with exceptional ease (e.g., the band supports reuse rather than being a one-time product as was the case with many prior one-size-fits-all straps). This embodiment may be thought of as providing a band assembly made up of three "wearable" layers/band elements (see, for example, FIGS. 1 and 4) with each layer or element allowing the band assembly to cover or be used with a defined wristband size range or wrist size range (see FIGS. 2 and 3).

Figure 5:
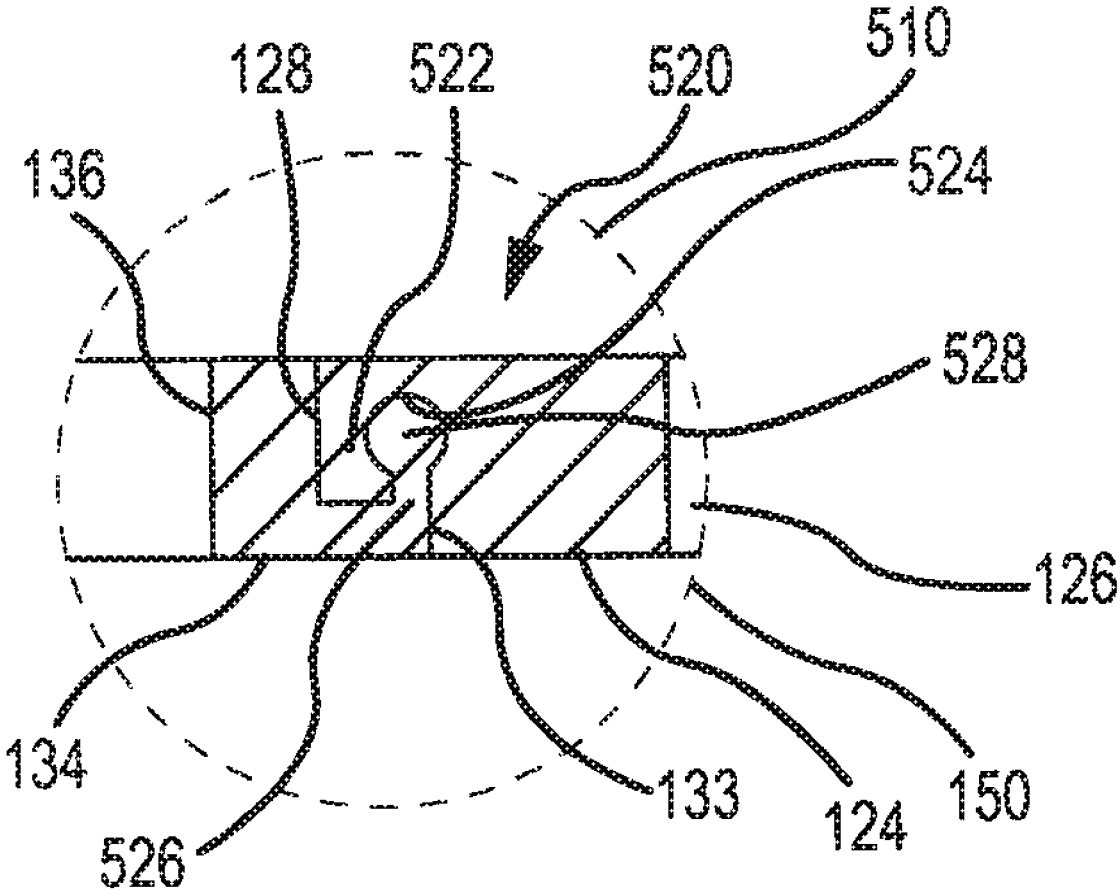
FIG. 5 is an enlarged view of the interlocking or coupling mechanism provided at the junction of an outer edge and an inner edge of two of the band layers or elements, which allows ready removal or peeling away of a layer/element and/or connection of new or interchanged layer/element (e.g., to increase the size of a band, to personalize/modify the look of the band with a new layer/element, or the like)

Each of the band layers/elements of a receiving (or sizing) band assembly may have one or more edges/sidewalls that are designed to provide an interlocking/coupling mechanism that allows the layers/elements to be locked together and to be separated by the user to size the wearable band assembly. For example, as shown in FIG. 5, the interlocking/coupling mechanism may take the form of a zipper/snap mechanism similar to those found in the end of resealable food storage bags or the like, or the interlocking/coupling mechanism may take the form of a peel away mechanism (e.g., a horizontally orientated tongue and groove arrangement similar to that found in some liquid beverage container caps with a removable security/sanitary band).

In use, the wristband assembly may initially be shipped or provided with all layers/elements assembled or coupled together such that the wristband is at its largest size or longest length (e.g., sized to fit a range of larger wrist sizes), and the ID member or element may be inserted into or receiving by the inner most or smaller/base band layer or element. The end users may then zipper/snap on or peel away layers or band elements (e.g., concentric rings of band material used to lengthen the band) to reveal or resize the wristband that fits their specific wrist size (e.g., wear "as is", remove only the outer layer/concentric band element, remove the two outer layers/concentric band elements, and so on).

In some cases, the removed layers may be replaced by other bands, too, so as to allow the end user to personalize/customize their band as well as to size it to their wrists or to allow the wristband to be used on more than one wrist size (e.g., not permanently sized upon removal/peeling away a layer or band element). In some cases, the smallest or inner band sizing layer or element may be inserted into or received within other product modules or bands so as to provide further interchangeability and/or personalization by the user, but, in some cases, the ID member/element is, instead, inserted into or attached to these product modules to provide further personalization and/or interchangeability of the ID member (e.g., a wearer may use a single ID member with an RFID module with a number of differing receiving band assemblies, which may be of a fixed size/design or be of configured for sizing to suit a number of wrists/users (such as shown in FIG. 1)).

Prior to the band designs presented herein, many wristbands used either an adhesive closure that is peeled away from the wristband or a separate, one-time plastic snap closure. The adhesive closures sometimes did not provide a desired closing strength and once removed could not be worn again. The plastic snaps provided a greater closing strength but were also often designed for one-time use, did not fit the wearer comfortably, and/or were too loose.

With regard to other band applications, a typical wristwatch incorporates a buckle-style watch clasp. Similar to shoe manufacturing, most wristwatches are designed to with a particular style with that same style or product run having a variety of wristwatch bands in different sizes to accommodate the specific end users' wrist sizes. However, similar to shoe shopping, when an end user purchases a wristwatch they try on different sizes of wristwatches (or wristwatch bands) of the same style to determine which band fits them appropriately. Because of the variability of different end user wrist sizes, the watch retailer must keep a large inventory of different wristband sizes to accommodate their customers, which significantly increases inventory costs for the retailer that may be acceptable in some settings (such as for higher end band products such as certain wristwatches). However, in many fashion and wearer ID settings (such as entertainment venues and the like), it is much more desirable to be able to provide a one-size-fits-all solution or band design that can be sized by the seller or the wearer to suit their wrist size rather than carrying numerous versions/sizes of the band. The described wearable bands provide a "one size fits all" design that, in some embodiments, provides three wearable and user-selectable/interchangeable band layers/elements, which allows a venue operator or provider of bands to maintain one common wristband inventory that accommodates a wide range of wrist sizes (e.g., address the multi-sizing problem associate with serving large audience/customer bases). In other cases, the ID member or element may be provided to the user/wearer who can then select among a number of product modules/receiving band assemblies to personalize their ID (or decorative) band.

Figure 3:
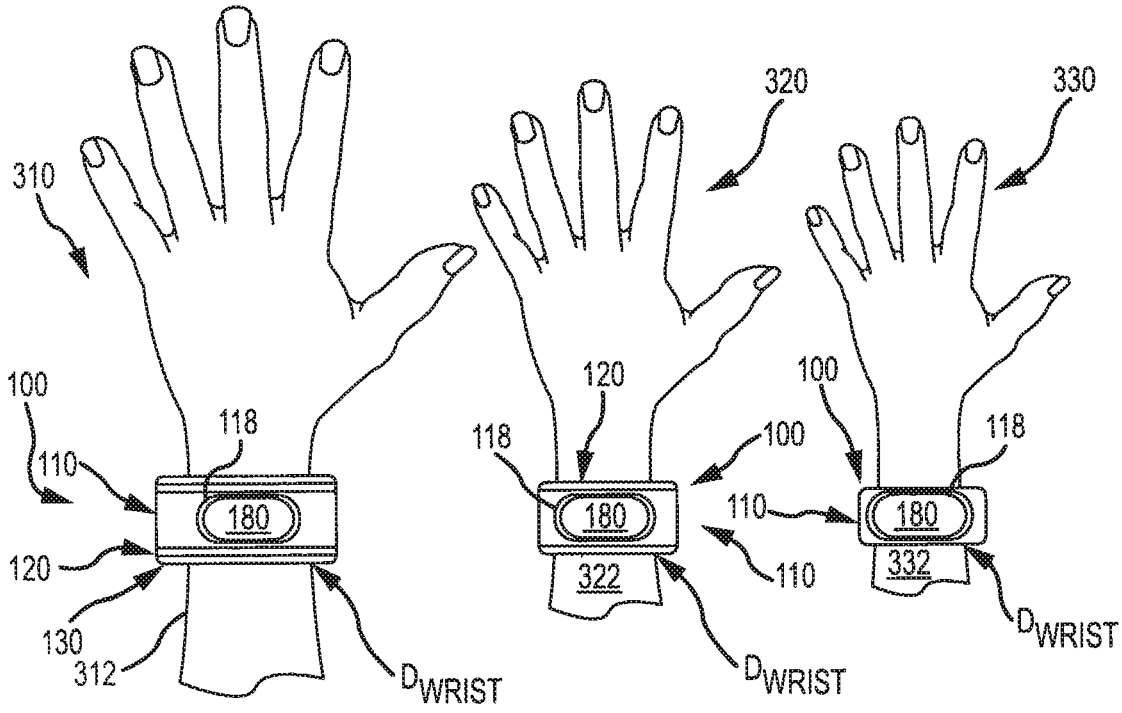
FIG. 3 illustrates three users or wearers wearing three of the band assemblies shown in FIG. 1 with three, two, and one of the band layers or band elements included so as to size the wrist assembly to three different sizes of wrists associated with users/wearers (e.g., including more layers/element increases the size of the band while peeling away or removing layers/elements reduces the size of the band)

FIG. 1 illustrates one embodiment of a wearable band assembly 100 that may be used to provide a single band product that can be worn or used by people (i.e., wearers or users) with wrist sizes that fall within one of three predefined size groups. The band assembly 100 includes an ID member or element 170 that is interconnected or coupled with a receiving or sizing band assembly made up (in this particular embodiment) of a set of three layers or band elements 110, 120, 130 and a clasp 150 for fastening the interconnected band elements/layers 110, 120, 130 to a wearer's wrist (as shown in FIG. 3). The wearer may simply peel away or remove layers 120 and 130 or only layer 130 to size the band assembly 100 to fit their wrist.

The first or inner layer or band element 110 may be thought of as the base or minimal layer of the receiving or sizing band assembly as this layer/element 110 is included in each configuration of the wearable band assembly 100. The wearable band assembly 100 may be used as an ID band for the wearer, and, in this regard, the assembly 100 includes an ID member or element 170 that is mated with or coupled to the inner band element 110. The inner band element 110 has a body 112 that extends from a first end 114 to a second end 115 with a first length, $L_1$, which is the minimum size of the band assembly 100. The shape of the body 112 is defined by an outer edge or sidewall 113 that extends about the periphery of the body 112, and, as shown, the body may be rectangular with rounded or circular ends 114, 115. The outer edge 113 of the body 112 also includes a portion of a coupling or interconnecting mechanism (such as shown in FIG. 5 or other configuration useful for connecting to layers of the assembly 100) used to connect or lock it to adjacent layer/element 120. The body 112 also include a number of holes 116 extending through its thickness at each end 114, 115 such that the clasp 150 may be inserted into or mounted on a hole 116 in one end 114 or 115 and then the clasp 150 may be extended through a hole 116 in the opposite end 114 or 115 to securely close the band assembly 100 upon a wrist when the band assembly 100 is configured/sized to only include the layer/element 110.

Significantly, the layer or band element 110 also may be adapted to receive and support the ID member 170. The ID member 170 may have a body 172 (e.g., a thin, planar body that may be rectangular as shown or take a differing shape) that extends from a first end 173 to a second end 174 and has an outer shape defined by sidewall/edge 176. The body 112 of the inner band element 110 includes a hole or passageway 118, and the ID member 170 includes an ID or RFID module 180 mounted on its body 172. The body 112 may have a recessed surface (not shown in FIG. 1) for receiving the body 172 of the ID member 170. The ID module 180 may then extend through the hole or passageway 118 or be flush with or recessed within hole 118 (but, in other embodiments not shown, the module 180 may be hidden or covered by the body 112). The ID member body 172 may include one, two, or more posts or prongs (with or without heads) that may be pushed into a like number of holes 116 in the body 112 to couple the ID member body 172 with the inner band element body 112. In this manner, the band assembly 100 is adapted for identifying the wearer by the inclusion of an RFID transceiver or RFID element 180.

The wearable band assembly 100 and its receiving assembly also includes a second or middle (or intermediate) layer or band element 120 that can be selectively coupled to the edge 113 of the inner layer 110 as part of sizing or personalizing the band assembly 100. The middle layer 120 has a body 122 that extends from a first end 124 to a second end 125 with a second length, $L_2$, that is greater than the length, $L_1$, of the inner layer 110. This allows the body 122 to extend about the periphery of the inner layer 110 and allows the combined layers 110, 120 to provide a longer configuration of the band assembly 100 (which allows it to be worn by a second group of wearers with larger wrists than those associated with wearers of the assembly 100 with only the inner layer 110).

The body 122 may again be generally rectangular in its outer shape with rounded ends 124, 125 as defined by an outer edge or sidewall 128. Also, like the inner layer 110, the body 122 of the middle layer 120 may include a number of holes 126 in each end 124, 125 such that the clasp 150 (with a clasp head 152 or portion larger than the holes 126 being shown in FIG. 1 that prevents it from passing through the holes 126) may be mounted on the layer 120 when the assembly 100 only includes layers 110, 120. As shown, the holes 126 are arranged along a line such as a center longitudinal axis of the body 122 and this aligns the holes 126 in each end 124, 125 (and with the holes 116 of body 112 which are also arranged in a linear manner). To allow the inner layer 110 to be mated with the middle layer 120, the body 122 of the middle layer 120 includes a central hole defined by an inner edge or sidewall 123. The hole defined by the inner edge 123 generally has a shape and dimensions that match the dimensions and shape of the body 112 as defined by its outer edge/sidewall 113 (e.g., the hole has a length, $L_1$, and is generally rectangular with rounded ends to receive ends 114, 115). The sidewalls/edges 123, 128 are configured to couple with the outer sidewall 113 of the inner layer 110 and with the inner sidewall 133 of the outer layer 130, respectively, such as by providing coupling or interlocking mechanism as shown in FIG. 5 or the like.

The receiving or sizing assembly of wearable band assembly 100 further includes a third or outer layer or band element 130 that can be selectively coupled to the outer edge 128 of the middle layer 120 as part of sizing or personalizing the band assembly 100. The outer layer 130 has a body 132 that may be similar in configuration as the middle layer 120 in that the body 130 extends from a first end 134 to a second end 135 with a third length, $L_3$, in that each end 134, 135 includes a number or set of holes 136 for receiving the clasp 150 for mounting and for closure of the band 100, and in that the body 130 includes a central hole or gap defined by an inner sidewall or edge 133 so as to be able to receive and couple with the outer sidewall 128 of the middle layer 120.

The length, $L_3$, of the outer layer 130 is longer than the length, $L_2$, of the middle layer 120 such that when the band assembly 100 includes all layers 110, 120, and 130 the band assembly 100 has a larger band size that allows it to be worn or used by a group of wearers with larger wrists falling within a third wrist size range. The body 132 may have an outer shape similar to that of the inner and middle layers 110, 120, e.g., an elongate rectangle with rounded ends 134, 135 as defined by outer sidewall or edge 138. The hole or gap defined by the inner sidewall or edge 133 has a shape and dimensions (e.g., a length equal to $L_2$) that match the body 122 of the middle layer 120 such that middle layer 120 may be received in this hole or gap, and the inner sidewall 133 is configured to couple or interconnect with the outer sidewall 128 of the body 122 (e.g., to provide a coupling/interconnecting mechanism as shown in FIG. 5 or the like).

The bodies 112, 122, 132, 172 may be formed of the same or differing materials, and these materials may vary to implement the assembly 100. In some embodiments, the bodies 112, 122, 132, 172 are formed of a plastic, a rubber (e.g., a silicone or the like), or similar material that may be relatively rigid but still be comfortable to wear and also be flexible to facilitate coupling of the layers 110, 120, 130, 172 at their paired/mated edges, 118/180, 113/123 and 128/133. The number of holes 116, 126, 136 may also be varied widely to practice the assembly 100 as well as the spacing between adjacent ones of the holes 116, 126, 136. Generally, one to three or more holes will be provided on each end 114, 115, 124, 125, 134, 135 such that the clasp 150 may be mounted and to allow connection of the two ends of a particular body 112, 122, 132 and to allow the band assembly 100 to be sized for a range of wrist sizes in each of its three configurations (i.e., band element 110 provides a range of sizes, the combination of band elements 110 and 120 provides a range of sizes, and the combination of band elements 110, 120, and 130 provides a range of band sizes via the inclusion of the holes rather than a single size with each configuration). Note, the band assembly 100 is shown to include three layers 110, 120, 130 but the assembly may include only two layers 110 and 120 to practice the assembly 100 or it may include four or more layers (e.g., layers 110, 120, 130 plus additional layers) so as to support a fewer or greater number of wrist size ranges (rather than the three shown in FIG. 1).

Figure 2:
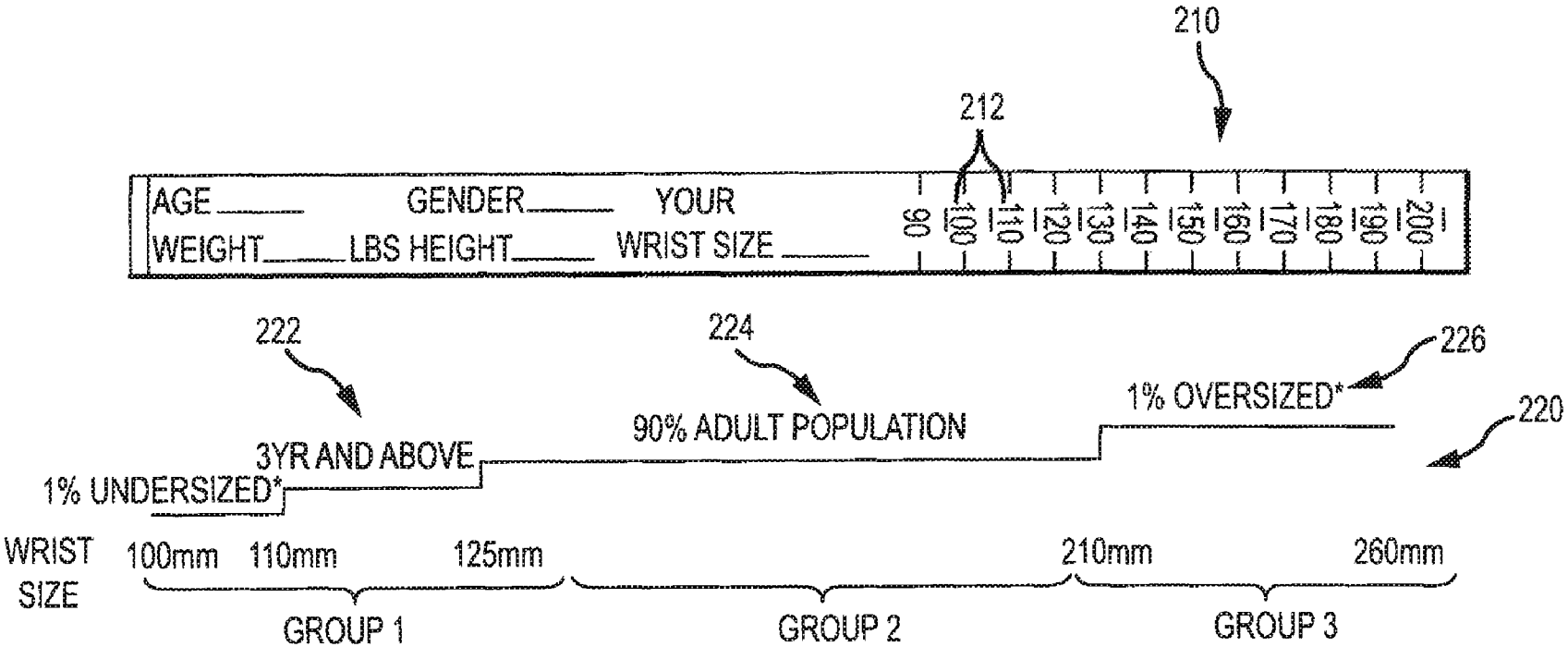
FIG. 2 illustrates a tape measure or tool that may be used by a purchaser/wearer of a band assembly to size their wrist and further illustrates a graph showing grouping of wrist sizes or ranges of wrist sizes to correspond to lengths/sizes of a wrist assembly (such as the assembly of FIG. 1) via inclusion or exclusion of a number of band layers or band sizing elements (or simply "band elements")

FIG. 2 illustrates a tape measure 210 that may be used by a wearer to determine or measure their wrist size. The tape measure 210 includes markings 212 that indicate the measured size when the tape measure 210 is wrapped about the wrist and aligned with the end of the tape measure 210. As shown, the smallest wrist size is typically about 90 millimeters (mm) while the largest wrist size is over 200 mm (such as about 260 mm or more). In one embodiment, the band assembly 100 may be provided or shipped with the tape measure 210, and the user/wearer may use the tape measure to determine their wrist size. This wrist size may then be used to determine whether to remove any of the interchangeable layers 120, 130 and if so, whether to remove one or both of the layers to properly size their wrist band assembly 100.

In this regard, graph 220 illustrates exemplary groups 222, 224, 226 that may be provided for a band assembly 100 for a typical human population. In this example, the band assembly 100 is a wristband and graph 220 represents differing wrist sizes for which it is desirable to provide a multi-sizing band assembly 100. As shown, a first group 222 that typically includes children and adults with a smaller wrists is shown (e.g., wrists of about 100 to 130 mm or the like), and, in the band assembly 100, the first or inner layer 110 may be provided with a length, $L_1$, and holes 116 to allow it to be worn by people with wrists falling into the first group 222 (e.g., less than about 130 mm in "diameter").

A second group 224 may be defined or selected to include a range of "average" teens and adults. For example, the second group 224 may range from about 130 mm (or some number smaller to provide overlap with group 222 such as 125 mm) to about 190 mm or the like, and the middle or intermediary layer 120 may have a length, $L_2$, that is chosen in combination with its arrangement of holes 126 to allow the band assembly 100 with coupled layers 110, 120 to be worn by individuals having a wrist size between 130 and 190 mm (or other lower and upper bounds). Finally, in this example, a third group 226 may be defined to include people with larger wrists such as wrists of 190 mm to 240 mm (or some other lower and upper bounds with the lower bound often being chosen to provide an overlap of the second and third groups 224, 226 such as 185 mm when the second group upper bound is 190 mm). The outer band layer 130 may then be chosen to have a length, $L_3$, and arrangement of holes 136 such that people with wrist sizes falling in the third group 226 would be able to wear the band assembly 100 when it included (as shown in FIG. 1) all three layers 110, 120, and 130 coupled together at their adjacent/abutting edges or sidewalls.

FIG. 3 illustrates the use of the band assembly 100 in three different configurations 310, 320, 330 to provide a band with three differing lengths (i.e., lengths $L_3$, $L_2$, and $L_1$, respectively). In configuration 310, the band assembly 100 is configured as shown in FIG. 1 to include all three layers or band elements 110, 120, 130 coupled together (or prior to peeling away element 130 or element 120) along with ID member with module 180 shown. In this configuration, the band assembly 100 has the length, $L_3$, and it can be fastened using the clasp 150 to be worn on a wrist 312 with a diameter, $D_{Wrist}$, that falls within a range of larger wrist sizes (e.g., group 226 of FIG. 2 which may be wrists of about 190 mm to 260 mm or more). In this manner, the ID technology element 118 within inner band element 110 is included in the band 100 as are sizing or accessory band elements 120, 130 (e.g., in some embodiments, the band elements 120, 130 may be exchanged or interchanged by the wearer for non-standard or original elements so as to customize the look to suit the wearer).

In configuration 320, the band assembly 100 has been modified or sized to suit a smaller wrist 322 with a smaller or more "average" wrist diameter, $D_{Wrist}$, or size. To this end, the outer band element or layer 130 has been removed or peeled away from the middle or intermediary band element 120 (e.g., the coupling between the outer sidewall of the band element 120 and inner sidewall of the band element 130 has been broken or disengaged). Note, the intelligence or ID technology element 180 is still present in the assembly 100 even after the modification/sizing such that the person can be identified by wearing the assembly 100. In configuration 330, the band assembly 100 has been modified or sized further to suit an even smaller wrist 332 with a smaller or below average wrist size or diameter, $D_{Wrist}$. To this end, the middle or intermediary band element or layer 120 has been removed or peeled away from the inner band element 110 (e.g., the coupling between the outer sidewall of the inner band element 110 and the inner sidewall of the middle band element 120 has been broken or disconnected). Again, even in this smallest configuration 330 with only the inner layer 110 being worn, the intelligence of the band 100 or the ID technology element 180 is present on the wrist 332 to identify the wearer (e.g., when an RFID component is read by an RFID reader, a bar code is read by a bar code scanner, and so on).

Figure 4:
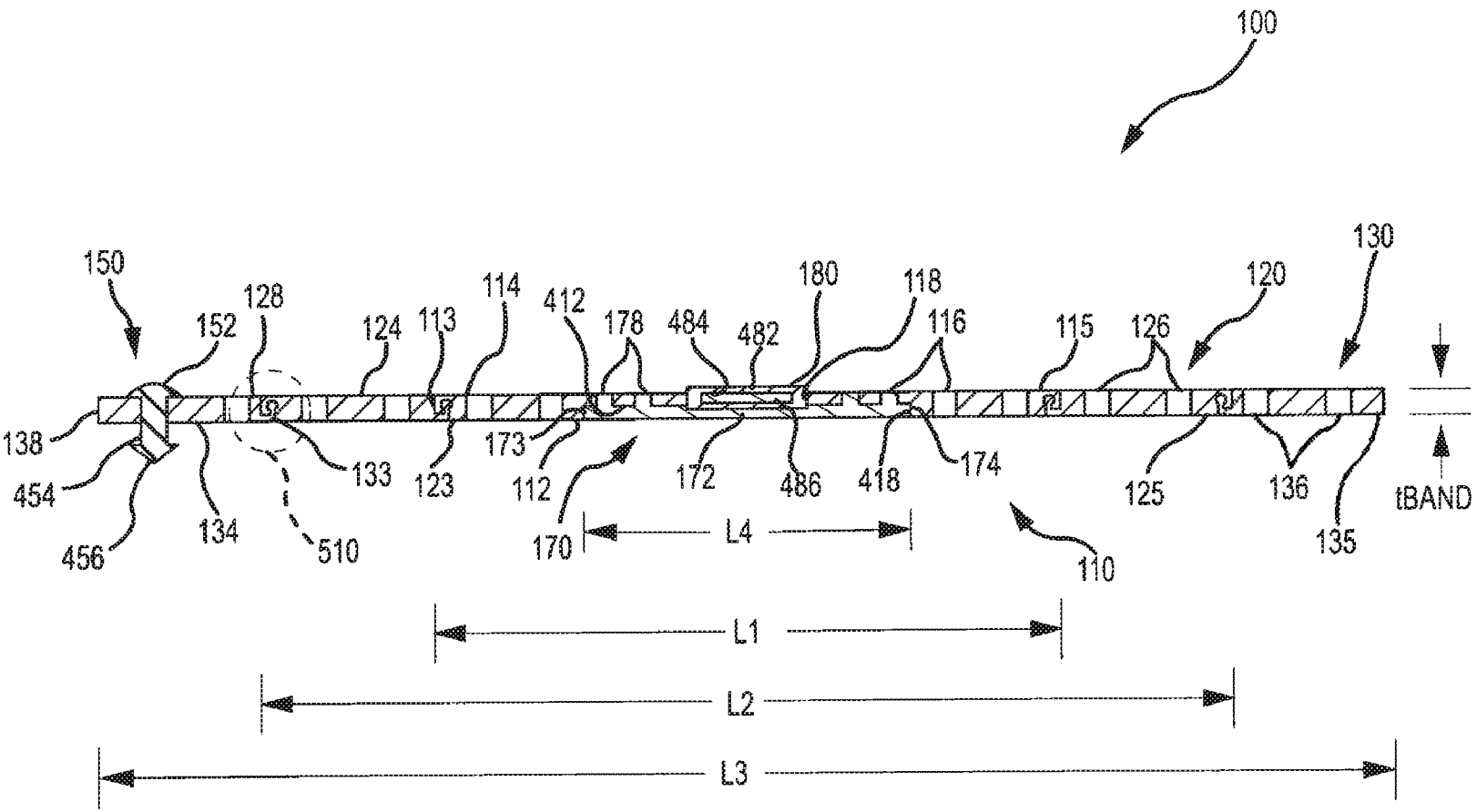
FIG. 4 is a sectional view of the band assembly of FIG. 1 taken along line 4-4.

FIG. 4 is a sectional view of the wearable band assembly 100. As shown, the band assembly 100 is made up of a number of concentrically arranged band elements (or layers) 110, 120, 130 (e.g., an inner band element or core element is surrounded by one or more rings/band elements that expand the width and the length of the band assembly 100) with ID member 170 received within band element 110. Specifically, inner band element 110 is positioned at an inner or central point of the assembly 100 and is coupled to the next ring of the assembly 100 provided by middle or intermediary band element 120. Then, outer band element 130 provides a third concentric ring of assembly 100 when it is coupled with the middle band element 120. With the addition of each band element 120, 130 and, in some cases (not shown) additional band elements, the length of the band assembly is increased and so is the width of the band assembly as can be seen in FIG. 1 (as material of a surrounding band element body 122, 132 is provided about the next inner rings of the band assembly 100).

As shown, in this embodiment, the ID member 170 is positioned within a recessed surface within a recessed surface of the inner band element 110 that is defined by an upper surface 412 and sidewalls 418. The height of the sidewalls 418 may be at least about the thickness of the body 172 of the ID member 170 to fully receive the member 170. The posts/prongs 178 extend from the body 172 of the ID member 170 through holes 116 in the inner band element body 110. The ID member 170 may include a head/central portion providing the ID module 180, and this central portion or head may be defined by a wall 482 that abuts hole sidewalls 118 of body 112. The wall 482 may define a chamber 484 to receive an ID component 486 (e.g., an RFID module 486 may be over-molded by material to form the wall 482 on body 172). The ID module 180 may extend outward a small distance from the body 112 (or extend outward/through hole 118) or be flush in other implementations. The recessed surface provided by sidewalls 418 may have a length, L4, that is about the length of the ID member body 172 (e.g., to provide a press fit or be somewhat longer to allow for manufacturing tolerances and coupling being provided by posts 173 and/or mating between ID module sidewalls 482 and hole sidewalls 118).

The bodies 112, 122, 132 of the band elements 110, 120, 130 may generally have a single thickness, $t_{Band}$, such that the band assembly 100 is a substantially planar and typically thin product or device (e.g., 0.0626 inches to about 0.25 inches may be a typical thickness range for a plastic or rubber band assembly 100). The ID member 180 may be thicker than the other portions of the body 112 and include a cavity or pocket 484 that may hold an ID device 486 (e.g., an RFID chip or transceiver) while in other cases the ID component 486 and/or sidewalls 482 of member 180 may be replaced by a timepiece or a fashion/personalization component. The sidewall 482 of ID member 180 may be formed of the same material as body 172 (and body 112) or a differing material such as metal or a hard plastic when the material of bodies 112 and 172 may be rubber or another material such as leather.

The clasp 150 may take many forms such as a multi-prong/poppet arrangement to engage two or more holes 116, 126, or 136 of one of the band elements 110, 120, 130 (e.g., the outer ring or band element of the current configuration of the band assembly 100). As shown, the clasp 150 has a head 152 that mates with an upper surface of an end 134 of the outer band element 130 as the shaft or post 454 of the clasp 150 is extended through a hole 136 in the body 132 of the outer band element 130. The tip or end 456 of the clasp post 454 may have a larger diameter to provide shoulders that mate with an opposite end 135 when the band assembly 100 is shape attached to a person's wrist or placed in a circular arrangement and closed/clasped together at its ends 134, 135. The length of the post 454 may be chosen such that the spacing between the lower surface of the body 132 (or 122 or 112 in differing configurations of assembly 100) and the shoulders of the tip 456 is at least about the band thickness, $t_{Band}$, such that the tip 456 engages the surface of the body 132 at the opposite end 135 when the post 454 is extended through another hole 136 in the body 132.

As shown in FIG. 4, each of the band elements 110, 120, 130 is coupled or interconnected with the adjacent band element(s) via a configuration of their abutting sidewalls 113, 123, 128, 133. Such interconnection may be performed or provided for in a number of ways to practice the band assembly 100 with it typically being desirable that the band elements 110, 120, 130 be securely held or locked together but that the layers/elements 120, 130 be removable. Typically, such removal can be done without tools (e.g., peel away or unzip the outer rings/band elements 120, 130). Further, many embodiments provide such interconnection in a manner that allows a removed band element 130 and/or 120 to be reattached or replaced with another band element (e.g., to personalize or customize a band assembly 100 with different band elements that may have different colors, artwork, graphical embellishments personal to the wearer, and so on).

To this end, FIGS. 4 and 5 illustrate one such coupling or interconnecting mechanism or assembly 520. The coupling mechanism 520 is shown most clearly in FIG. 5 in the enlarged view 510, and it may be considered an L-shaped bulb or post arrangement with one sidewall providing an over-mould or groove for receiving the bulb/post. As shown, the middle band element or layer 120 is coupled or joined to the outer band element or layer 130 via the coupling mechanism 520. The coupling mechanism 520 may be thought of as a zipper or snap configuration similar to that found in the ends of many plastic food storage bags. In the mechanism 520, the coupling or mating components generally provide a vertical snapping/zipping mechanism in that the interlocking components extend transverse to the plane containing the bodies 112, 122, 132 of the band elements 110, 120, 130.

Specifically, the sidewall or edge 128 of the middle band element 120 provides a vertical wall or element 522 that extends vertically away (such as "downward" in the figure) from a horizontal/outer surface of the body 122, e.g., extends at least about half the thickness, $t_{Band}$, of the band body 122. The vertical element 522 defines a groove or trough (or female mating surface) 524 that extends into the material of the body 122 (e.g., one third to two thirds of the height of the vertical element 522). The joining mechanism 520 further includes as part of the inner sidewall 133 of the outer band element 130 a vertical element 526 that extends vertically from the planar outer surface of the body 132 (e.g., transverse to a plane passing through the body 132), and this vertical element 526 may define a trough or groove for receiving the vertical element or wall 522 of the middle band element 120. The vertical element 526 may extend vertically (e.g., "upward" in the figure) a distance of about one half to two thirds or more of the band thickness, $t_{Band}$, into the groove or trough 524 of the body 122.

To provide a secure or snapping fit, the vertical element 526 may include a tip, head, or zipper engagement member 528 that has a greater diameter than the adjacent vertical element 526 and that matches (or corresponds to) the size and shape of the receiving trough/groove 524. In this manner, the coupling of the band elements 120, 130 is provided when the tip 528 is snapped or zipped into the groove 524 such that the vertical element 526 typically will not unintentionally separate from the vertical element 522 (e.g., a user can unzip or peel away the layer or band element 130 but some predefined amount of force must be applied when such separation or decoupling is desired). In brief, one of the sidewalls or edges 128 is configured to provide a vertically arranged (i.e., transverse or even perpendicular to a plane extending through the band bodies 112, 122, 132) female coupler while the adjacent and mating edge or sidewall 133 is configured to provide an opposite vertically arranged, male coupler. Typically, the cross sectional shapes and dimensions of these coupling components 522, 524, 526, 528 correspond but some embodiments may provide some tolerances to account for manufacturing (e.g., have the tip 528 be smaller in diameter or width than the trough/groove 524) or may be selected to achieve more of an interference fit (e.g., have the tip 528 have a larger diameter or width than the groove 524).

Figure 6A:
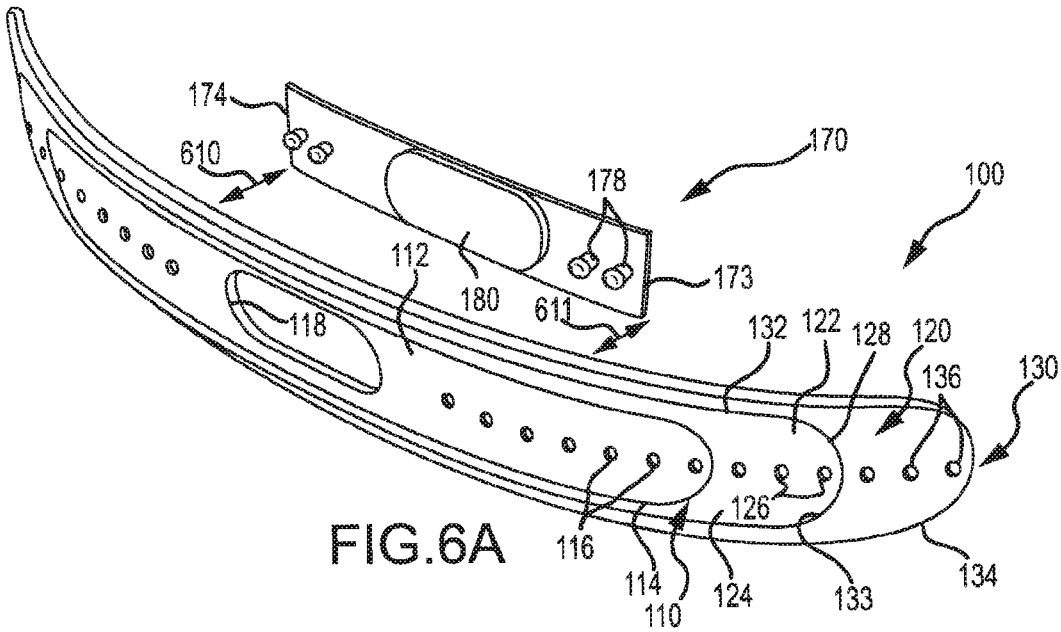
FIGS. 6A and 6B are exploded views of the band assembly of FIGS. 1 and 4 showing how the three layers/elements may be interconnected or interchanged with an ID member to provide a band with a particular look and feel by selecting the interchangeable wristband product module defined by the three sizing/receiving band elements (inner, middle, and outer band elements)
Figure 6B:
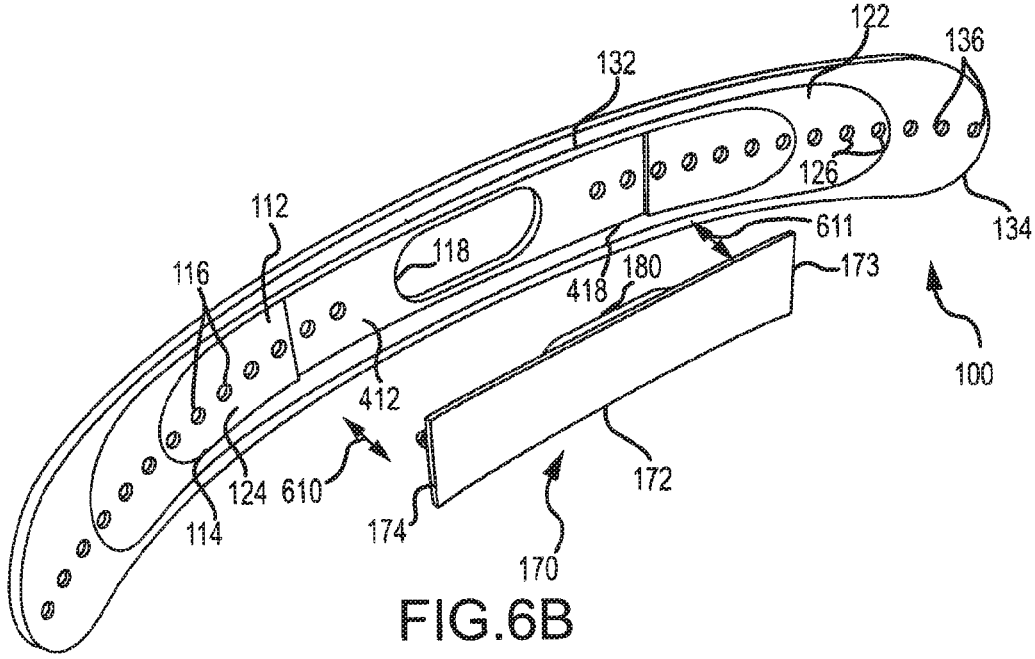

FIGS. 6A and 6B illustrate a partially exploded view of the wearable band assembly 100 of FIGS. 1 and 4 with the interchangeable ID member 170 removed from the inner band element 110. As shown by arrows 610, 611, the ID member 170 may be selectively inserted into the recessed surface of element 110 defined by top surface 412 and sidewalls 418. The receiving or sizing band assembly provided by the three band elements 110, 120, 130 may be thought of as an interchangeable wristband product module in that a wearer can choose to use their RFID module 180 in ID member 170 with the inner band element 110 with or without elements 120, 130.

In this way, the wearer may use the assembly 100 as a base or received product for their identification or may select the product module with a particular design, coloring, or other product aspect making the assembly 100 unique or to suit their tastes/desires. When assembled, as shown in FIG. 1, the RFID module 180 is inserted into the hole/passageway 118, and the body 172 is placed in contact with or to abut the surface 412 of the inner band element 110. Ends 173, 174 also abut or at least are placed proximate to sidewalls 418. The posts/prongs 178 are typically pushed through the holes 116 to couple the ID member 170 to the inner band element 110 (e.g., to form the wearable band assembly 100).

Figure 7:
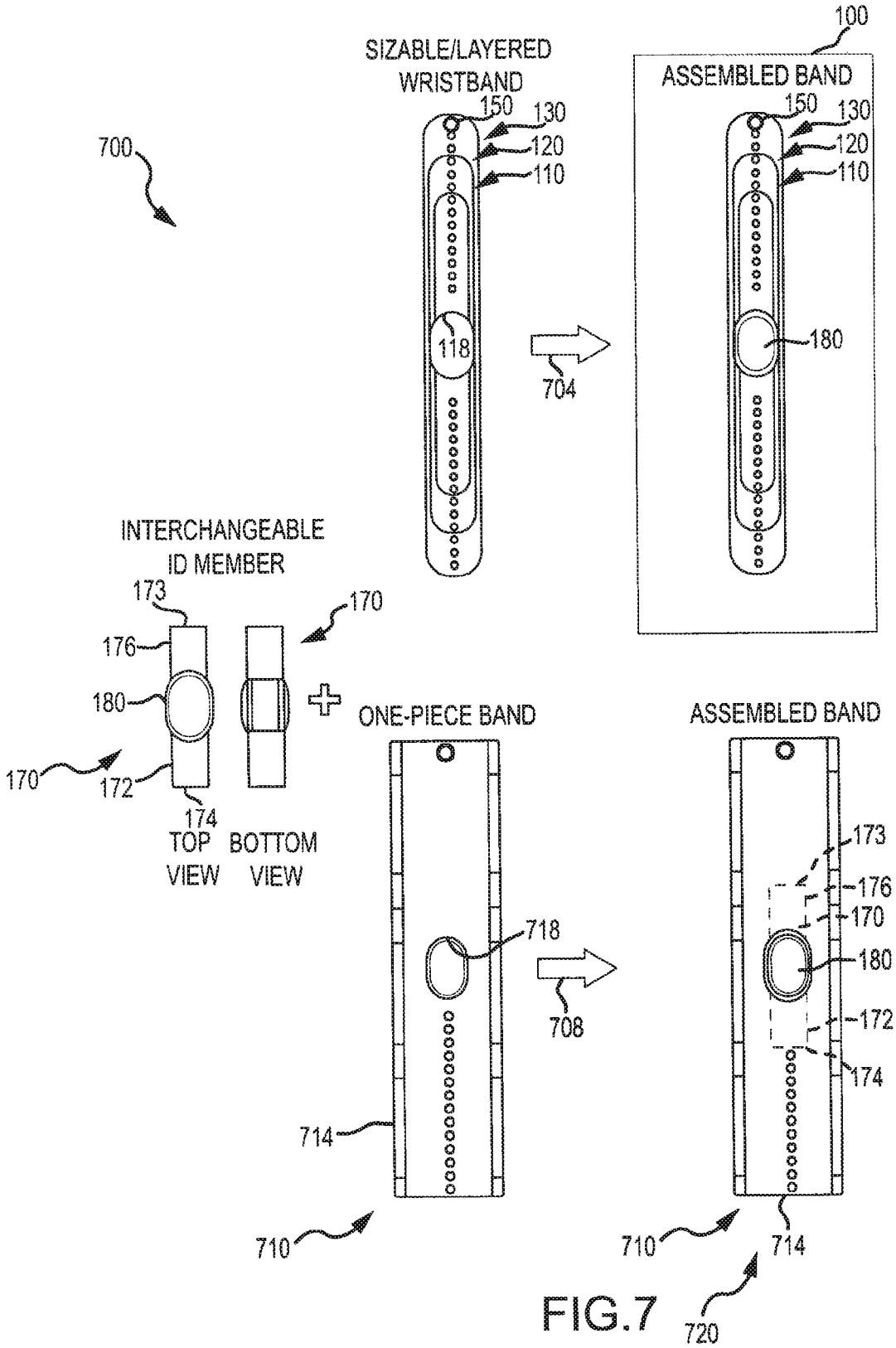
FIG. 7 illustrates a top and bottom view of an ID member and then assembly of this ID member with a layered or user-sizable wristband assembly and with a one-piece band to form two differing assembled bands or wearable band assemblies.

FIG. 7 illustrates a user assembly and/or selection process 700 that may be used to form two differing assembled, wearable band assemblies 100, 720. As shown, a user or wearer may be provided an interchangeable ID member 170 with a body 172 (defined in part by sidewall 176 extending from end 173 to end 174), and the body 172 includes an RFID module 180 (or a decorative element in some embodiments and/or a timepiece or similar component). The ID member 170 may be thought of as the base component that is used to build one or more wearable band assemblies 100, 720 (or others with differing product modules/platforms). When the center component 180 is an ID module such as an RFID chip or transceiver, it may be programmed to stored data corresponding to the wearer such as access and/or rights data for entering and using particular facilities such as a resort, a theme park, an entertainment facility, and the like.

To allow the wearer to size and personalize the ID member 170 (as well as wear it), the wearer may be provided a sizable or layered wristband (or receiving band assembly) comprising a series of layers 110, 120, 130 and a clasp 150 as discussed above. The wearer may assemble 704 the wearable band assembly 100 by inserting the ID member 170 into a recessed or receiving surface such that the RFID module 180 extends into/through the hole/passageway 118. The ID member or base band element 170 is then coupled with the inner band element 110, and the wearer may size the assembly 100 to their wrist (or other body part) by retaining all elements 110, 120, 130 or selectively peeling away layer 130 or layers 120, 130.

Alternatively (or later after using assembly 100), the wearer may further size and personalize the ID member 170 by assembling 708 the wearable band assembly 720 by combining the ID member 170 with the one-piece band 710. The band 710 has a one-piece body 714 in this embodiment with a hole or passageway 718 and a recessed surface (not shown by similar to that of inner band element 110) for receiving and coupling with body 172 of ID member 170. The sizing of the wearable band assembly 720 is provided by selection of the body 714 such that the assembly 720 has a length that suits or fits the wearer. In other words, the wearer may use the tape measure or similar device as shown in FIG. 2 to size their wrist (or neck, ankle, or the like) and then provide this information in purchasing or requesting the one-piece band 710. Typically, the connection 708 of the ID member 170 to the body 714 is secure (e.g., requires user-applied force to remove) but is not permanent such that the wearer may remove the ID member 170 and use it with another wearable band assembly (such as assembly 100 or another assembly to further personalize or to resize the assembly such as to allow use of ID member 170 as they grow or by another in some cases).

Figure 8:
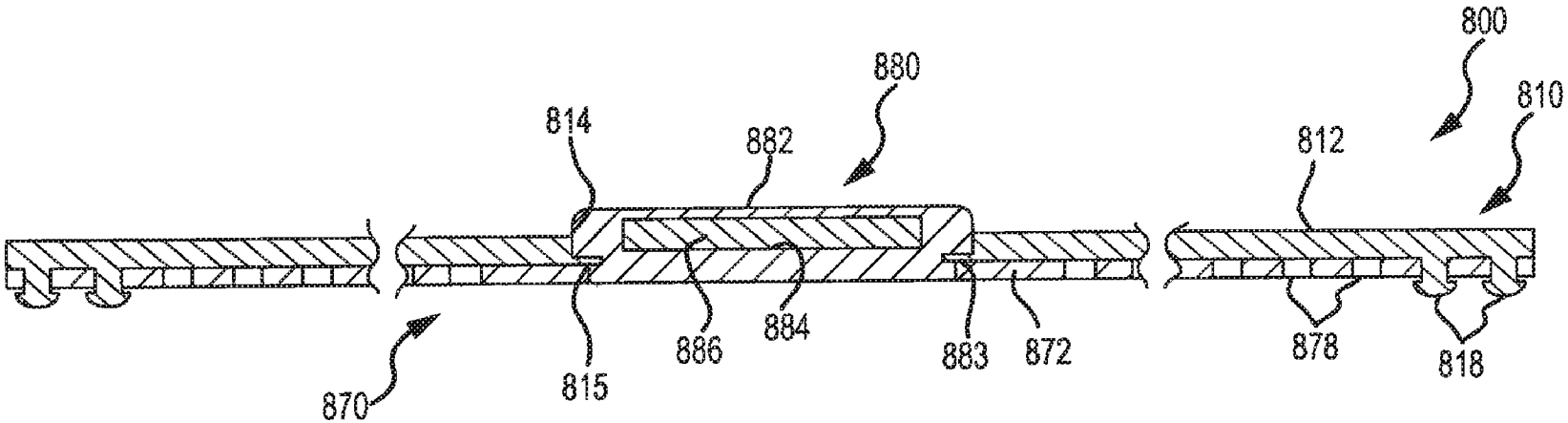
FIG. 8 is a partial sectional view similar to that shown in FIG. 4 of another wearable band assembly according to the description.

In some embodiments, a differing interlocking or coupling mechanism may be used to selectively or interchangeably affix an ID member or base element to a receiving band assembly (e.g., in place of posts/prongs other coupling techniques may be used to practice the invention). FIG. 8 illustrates a partial cross sectional view of a wearable band assembly 800 similar to the view provided in FIG. 4. As shown, a band layer or element 810 may be coupled with an ID member 870. In this embodiment, the ID member 870 may be received within a recessed surface of the body 812 of the band element 810 or it may simply provide the inner surface/layer of the assembly 800. As shown, the ID member 870 includes a planar body 872 with a number of holes or slots 878, and the body 812 may be at least partially interlocked to the body 872 via posts or prongs 818 extending from a bottom or inner surface of the body 812 and received or pressed through one, two, or more of the holes 878.

Additional coupling may be provided by the mating surfaces between the ID module 880 and the body 812. For example, as shown, the ID module 880 may include a wall 882 that defines an inner chamber 884 in which an RFID component 886 (or other ID technology or decorative/functional component such as a piece of jewelry or a timepiece) is positioned such as by over-molding an RFID tag 886 to form ID module 880 (e.g., ultrasonic welding of RFID device to thin/small band 812). To provide an interlocking snap-in connection, the body 812 may have sidewalls 814 defining a hole/channel for receiving the ID module 880 (sidewalls 882), and these sidewalls 814 may provide a lower shelf or mating prong 815 that extends about the hole defined by the wall 814. The sidewall 882 of the ID module 880 may have a channel or recessed surface 883 that is configured to receive the shelf/prong 815 when the ID module 880 is pressed through the hole defined by body sidewall 814. Hence, an interlocking "snap-in" design is provided by the configuration of the wearable band assembly 800, and the wearer may readily assemble and disassembly the ID member 870 and the band element 810 to suit their needs.

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention.

We claim:

1. A wearable band assembly, comprising:

an interchangeable band member comprising a planar body with a raised center portion;

a first band element with a body extending from a first to a second end and with an outer shape defined by an outer sidewall, wherein the first band element body comprises a recessed surface for receiving the interchangeable band member body, the recessed surface being defined by sidewalls extending into the first band element body a height less than a thickness of the first band element body;

a second band element with a body extending from a first to a second end, the body of the second band element having a length greater than a length of the body of the first band element and having a hole extending through the body of the second band element defined by an inner sidewall for receiving the body of the first band element; and a coupling mechanism detachably connecting the outer sidewall of the first band element body to the inner sidewall of the second band element body, wherein the first band element body comprises a passageway and wherein the raised center portion extends through the passageway when the interchangeable band member body is received in the recessed surface and wherein the height of the sidewalls defining the recessed surface is at least about a thickness of the body of the interchangeable band member.

2. The band assembly of claim 1, wherein the raised center portion comprises a user identification member including a radio frequency identification (RFID) module.

3. The band assembly of claim 1, wherein the first band element body is coupled to the interchangeable band member when the interchangeable band member body is received in the recessed surface.

4. The band assembly of claim 3, wherein a channel extends about the raised center portion and wherein a sidewall of the first band element body defines the passageway and includes a protruding shelf for mating with the channel on the raised center portion, whereby the interchangeable band member body is retained in the recessed surface.

5. The band assembly of claim 1, further comprising:

a third band element with a body extending from a first to a second end, the body of the third band element having a length greater than the length of the second band element body and having a hole defined by an inner sidewall for receiving the second band element body;

a second coupling mechanism selectively connecting an outer sidewall of the second band element body and the inner sidewall of the third band element body; and a clasp for clasping a pair of the first and second ends of the body of the third band element, the body of the second band element, and the body of the first band element together, wherein the first and second ends of each of the body of the third band element, the body of the second band element, and the body of the first band element includes a number of holes for receiving a post of the clasp.

6. A wearable band assembly, comprising:

an interchangeable band member comprising a planar body with a raised center portion;

a first band element with a body extending from a first to a second end and with an outer shape defined by an outer sidewall, wherein the first band element body comprises a recessed surface for receiving the interchangeable band member body, the recessed surface being defined by sidewalls extending into the first band element body a height less than a thickness of the first band element body;

a second band element with a body extending from a first to a second end, the body of the second band element having a length greater than a length of the body of the first band element and having a hole extending through the body of the second band element defined by an inner sidewall for receiving the body of the first band element; and a coupling mechanism detachably connecting the outer sidewall of the first band element body to the inner sidewall of the second band element body, wherein the bodies of the first and second band elements are substantially planar and wherein the coupling mechanism comprises a first coupling component extending along the outer sidewall of the first band element and a second coupling component extending along the inner sidewall, whereby the first and second band elements are connected along an entire periphery of the hole.

7. A wearable band assembly, comprising:

an interchangeable band member comprising a planar body with a raised center portion;

a first band element with a body extending from a first to a second end and with an outer shape defined by an outer sidewall, wherein the first band element body comprises a recessed surface for receiving the interchangeable band member body, the recessed surface being defined by sidewalls extending into the first band element body a height less than a thickness of the first band element body;

a second band element with a body extending from a first to a second end, the body of the second band element having a length greater than a length of the body of the first band element and having a hole extending through the body of the second band element defined by an inner sidewall for receiving the body of the first band element; and a coupling mechanism detachably connecting the outer sidewall of the first band element body to the inner sidewall of the second band element body, wherein the coupling mechanism comprises a tongue extending outward from the inner or outer sidewall and a groove adapted for receiving the tongue provided along the inner sidewall when the tongue is provided on the outer sidewall and along the outer sidewall when the tongue is provided on the inner sidewall.

8. The band assembly of claim 7, wherein the body proximate to the tongue has a first hardness and the body proximate to the groove has a second hardness greater than the first hardness.

9. A wearable band assembly, comprising:

an interchangeable band member comprising a planar body with a raised center portion;

a first band element with a body extending from a first to a second end and with an outer shape defined by an outer sidewall, wherein the first band element body comprises a recessed surface for receiving the interchangeable band member body, the recessed surface being defined by sidewalls extending into the first band element body a height less than a thickness of the first band element body;

a second band element with a body extending from a first to a second end, the body of the second band element having a length greater than a length of the body of the first band element and having a hole extending through the body of the second band element defined by an inner sidewall for receiving the body of the first band element; and a coupling mechanism detachably connecting the outer sidewall of the first band element body to the inner sidewall of the second band element body, wherein the coupling mechanism comprises a vertical wall element spaced apart from the outer sidewall of the body of first band element and a vertical post element spaced apart from the inner sidewall of the body of the second band element, wherein the vertical wall element defines a groove for receiving the vertical post element including a head on the end of the vertical wall element.

10. An identification wristband, comprising:

an identification (ID) member comprising a body and an ID module supported by the body;

an inner layer comprising a substantially planar body with a recessed surface, wherein the body of the ID member is received within the recessed surface and the body of the ID member is coupled to the inner layer body;

a middle layer comprising a substantially planar body with a hole defined by an inner sidewall of the middle layer body, the hole of the middle layer body extending through the middle layer body and being adapted for receiving the inner layer body and wherein the inner sidewall is coupled to an outer sidewall of the inner layer body when the inner layer body is positioned within the hole of the middle layer body; and an outer layer comprising a substantially planar body with a hole defined by an inner sidewall of the outer layer body, the hole of the outer layer body being adapted for receiving the middle layer body and wherein the inner sidewall of the outer layer body is coupled to an outer sidewall of the middle layer body when the middle layer body is positioned within the hole of the outer layer body, wherein the middle layer body extends about a periphery of the inner layer body when the inner layer body is received in the hole of the middle layer body and wherein the outer layer body extends about a periphery of the middle layer body when the middle layer body is received in the hole of the outer layer body.

11. The wristband of claim 10, wherein the ID module comprises an RFID device storing data corresponding to a user of the wristband.

12. The wristband of claim 10, wherein the inner layer body is coupled to the middle layer body via a tongue and groove connection mechanism provided on abutting portions of the inner sidewall of the middle layer body and of the outer sidewall of the inner layer body.

13. The wristband of claim 12, wherein the middle layer body is coupled to the outer layer body via a tongue and groove connection mechanism provided on abutting portions of the inner sidewall of the outer layer body and of the outer sidewall of the middle layer body.

14. The wristband of claim 10, wherein the middle and inner layer bodies are detachably coupled when the inner layer body is positioned in the hole in the middle layer body and wherein the middle and outer layer bodies are detachably coupled when the middle layer body is positioned in the hole in the outer layer body.

* * * * *